US006149445A

United States Patent [19]

Daddono

[11] Patent Number: 6,149,445

[45] Date of Patent: Nov. 21, 2000

[54] CONTROL POD

[76] Inventor: Samuel J. Daddono, 285 W. Lake Shore Dr., Tower Lakes, Ill. 60010

[21] Appl. No.: 09/352,501

[22] Filed: Jul. 10, 1999

[51] Int. Cl.[7] ..... H01R 13/44

[52] U.S. Cl. ..... 439/133; 439/134; 439/367

[58] Field of Search ..... 439/133, 134, 439/304, 367

[56] References Cited

U.S. PATENT DOCUMENTS

| | | | |
|---|---|---|---|
| 3,059,209 | 10/1962 | Bird | 439/367 |
| 3,344,393 | 9/1967 | Hendee | 439/367 |
| 4,592,607 | 6/1986 | Pejovic | 439/133 |
| 4,643,505 | 2/1987 | House et al. | 439/367 |
| 4,705,335 | 11/1987 | Goebel | 439/133 |
| 4,865,557 | 9/1989 | Kershaw | 439/133 |
| 5,052,939 | 10/1991 | Koch | 439/133 |
| 5,061,194 | 10/1991 | Herman et al. | 439/133 |
| 5,393,237 | 2/1995 | Roy et al. | 439/133 |
| 5,566,847 | 10/1996 | Ali et al. . | |

*Primary Examiner*—T. C. Patel
*Attorney, Agent, or Firm*—Mathew R. P. Perrone, Jr.

[57] ABSTRACT

A control pod for a plug and cord assembly secures the electrical appliance to which the cord is attached and prevents insertion of the plug into a power outlet by having an upper section connected to a lower section by a hinge on one side and a lock oppositely disposed from the hinge.

16 Claims, 2 Drawing Sheets

Fig. 3.
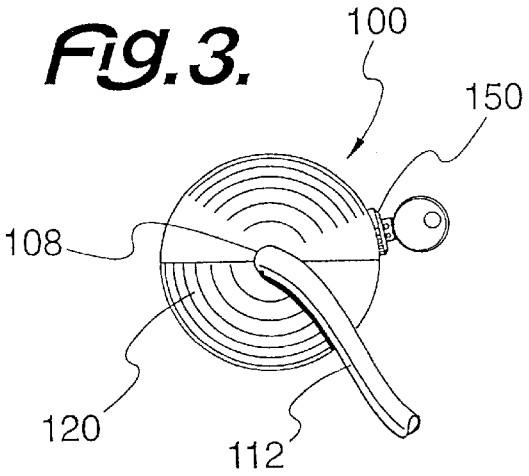
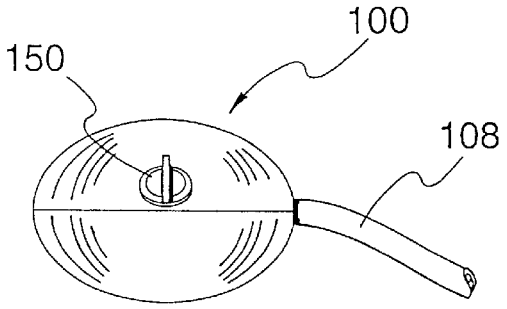
Fig. 4.
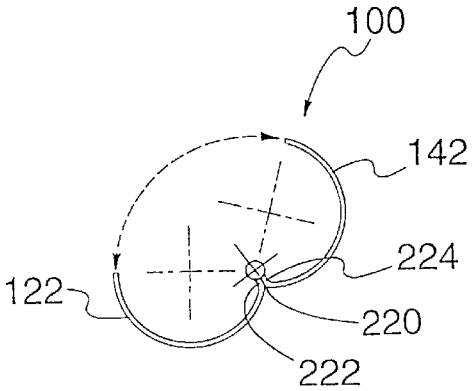
Fig. 5.
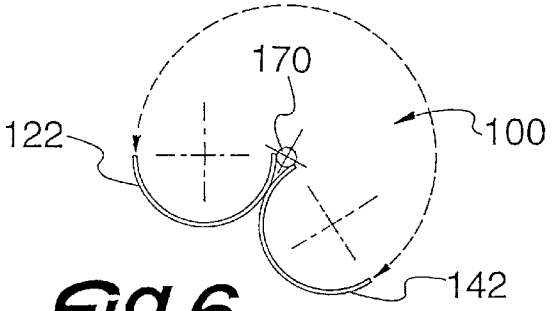
Fig. 6.
Fig. 7.
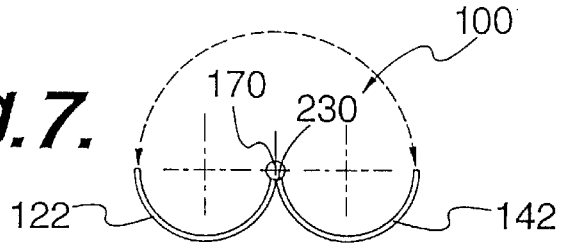

CONTROL POD

This invention relates to a control pod for securing an electrical device and more particularly to a control pod for securing the plug of an electrical device.

BACKGROUND OF THE INVENTION

Danger caused by electricity to persons in the workplace is a difficult problem to overcome. Many federal regulations are provided in order to protect the worker in the workplace, from the dangers of electrical plugs.

One protective device provides for a locking of the plug to a machine, while the machine is being maintained or repaired. With the plug locked, the machine cannot be unintentionally activated. This reduces the risk to the maintenance man and avoids unintentional plugging in of the machine, which can result in a danger to the maintenance man.

For example, as the maintenance man leaves to go on lunch, another party unaware that the maintenance is being carried out can activate the machine and plug in the cord. If the maintenance man forgets to check the plug, danger occurs. If the plug is locked, there is no chance for mistake.

In many cases, it is desired to prevent use of electrically powered equipment by unauthorized or untrained personnel. Whether the equipment is a power tool, a computer or another type of device, securing the plug will prevent unauthorized use. An efficient device for securing the plug can prevent such improper use.

Getting away from the industrial arena and proceeding to the home front, locking of the plug also prohibits a child from using an electrical device. If the plug is locked, the child may not turn on the power tool, the television or any other device sought to be protected from unauthorized use. Thus, the plugging protection is even needed in the home.

While the plug is locked in a protective cover, it is desirable to support the plug therein. With the plug supported within the pod, flex at the cord and plug union is minimized. With the flex minimized, wear at that point is minimized, and will last much longer. However, the cord protection and plug support work against each other. It desirable to maximize the advantages of both, but such is difficult to do.

SUMMARY OF THE INVENTION

Among the many objectives of this invention is to provide a control pod for securing an electrical plug in order to prevent use of the device, to which the cord and plug provide power.

Another objective of this invention is to provide a control pod for securing an electrical plug in order to secure an appliance in the home.

Yet another objective of this invention is to provide a control pod for securing an electrical plug in order to provide safety during maintenance of a machine.

Still another objective of this invention is to provide a control pod for supporting an electrical plug.

Additionally, an objective of this invention is to provide a control pod for an electrical plug, which limits use of an appliance.

Also, an objective of this invention is to provide a lockable control pod for an electrical plug.

A further objective of this invention is to provide a control pod for an electrical plug with minimal effect on a plug cord joint.

A still further objective of this invention is to provide a control pod for an electrical plug in to prevent unauthorized use of equipment.

Yet, a further objective of this invention is to provide a control pod for an electrical plug in to prevent unauthorized use of equipment.

These and other objectives of the invention (which other objectives become clear by consideration of the specification, claims and drawings as a whole) are met by providing a control pod for a plug and cord assembly in order to secure the electrical appliance, the control pod having an upper section connected to a lower section by a hinge on one side and a lock oppositely disposed from the hinge.

BRIEF DESCRIPTION OF DRAWINGS

FIG. 3 depicts an end plan cord view 120 view of the control pod 100 of this invention holding cord assembly 108.

FIG. 4 depicts an side lock view 130 view of the control pod 100 of this invention holding cord assembly 108.

FIG. 5 depicts the control pod 100 with beveled hinge edge 220, of this invention, wherein the hinge assembly 170 is mounted on the inside of the control pod 100.

FIG. 6 depicts the control pod 100, of this invention, wherein the hinge assembly 170 is mounted on the outside of the control pod 100.

FIG. 7 depicts the control pod 100, of this invention, wherein the hinge assembly 170 has a mid mounting point 200 and is partially mounted on the outside of the control pod 100.

Throughout the figures of the drawings where the same part appears in more than one figure the same number is applied thereto.

DESCRIPTION OF THE PREFERRED EMBODIMENTS

The control pod of this invention has an upper section and a lower section. Within each section are two plastic lips designed to hold the cord in its proper position. The hinge and spring are designed to cooperate and to hold the two sections together on one side. As the device closes, the plug head is contained therein and a locking mechanism prohibits the unauthorized opening of the control pod and prevents unauthorized of the appliance, for which, the cord supplies power.

Clearly any appliance having a plug can be secured with this control. Whether the appliance is a power tool, a computer, a household appliance or and other plug using device, if the plug is locked in the control pod of this invention, any appliance using that plug may get power to run.

Any durable material may be used to make the control. If high security is needed, metal may be used. Even tool strength metal can be used. Durable high impact plastic can also be used. Generally, the material used is determined by the security sought.

The locking mechanism can be by combination lock or by key. The lips to hold the plug in position prevent damage to the plug. The rounded nature or hollow elliptical nature of the plug pod makes for easy handling and decoration. It is the lips, locking, and the hinge and spring that provide the most effectiveness. The outer shape of the pod can be any suitable shape. However, the elliptical shape is desired.

The hinge assembly may be positioned either completely within the plug support control pod, on the outside thereof or somewhere in between. If the hinge is positioned in the middle of the wall of the pod, the sections of the pod can open about 180 degrees. If the hinge is positioned on the outside of the control pod, it is possible that the sections of the pod to open 240 degrees.

On interiorly mounted hinge, a beveled hinge edge of each section of the control pod permits the opening of the pod efficiently to get the plug inside. Where the wider opening is not desired and the beveling does not detract from the strength of the pod, the beveled edge may be used.

Figure 1:
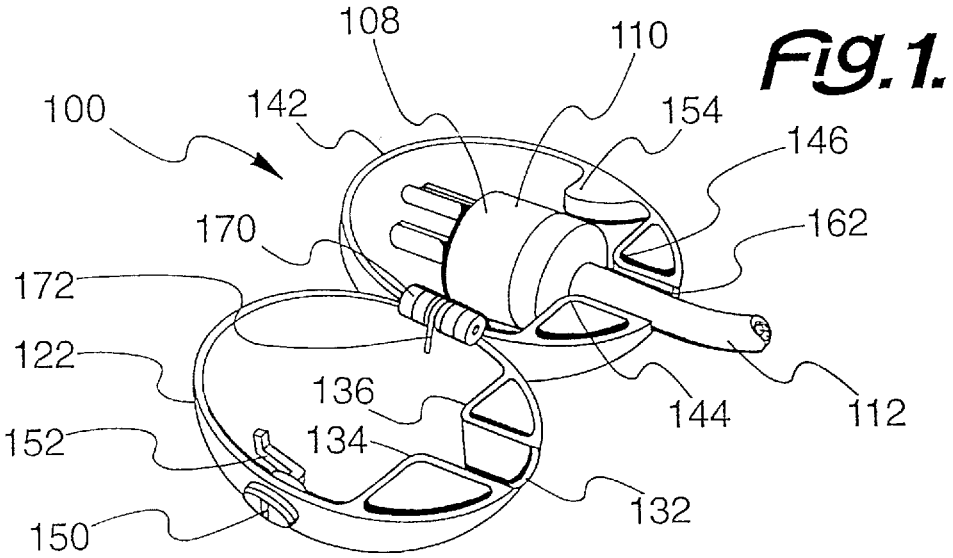
FIG. 1 depicts an open perspective view of a control pod 100 holding plug and cord assembly 108, with a key lock assembly 150, of this invention.
Figure 2:
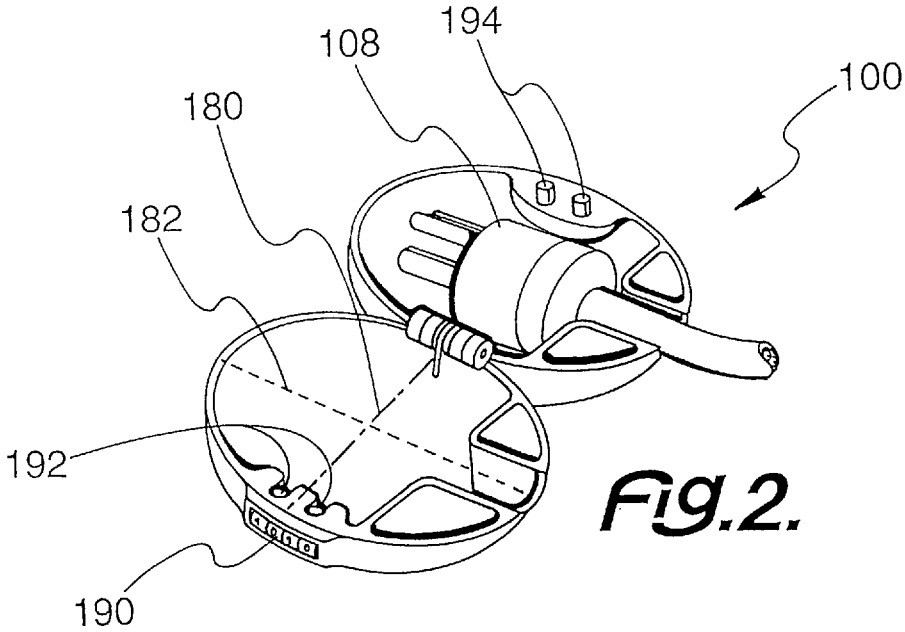
FIG. 2 depicts a open perspective view of the control pod 100 holding plug 110, with a combination lock 160, of this invention.

Referring now to FIG. 1 and FIG. 2, the control pod 100 includes a lower section 122 and an upper section 142. Both lower section 122 and upper section 142 are elliptically shaped hollow hulls.

However, at the lower part of lower section 122 is a plug support 124. Plug support 124 includes first lower radiused brace 134 and second lower radiused brace 136. Therebetween to support cord 112 is a first arc 132 at the base of the lower section 122. This first arc 132 provides for the cord 112 while first lower radiused brace 134 and second lower radiused brace 136 support plug 112. The combination of first arc 132 with first lower brace 134 and second lower brace 136 provide for support of the plug assembly 108.

In FIG. 1 particularly, mounted in the lower section 122 is a key-lock assembly 150 with lock bolt 152 protruding therefrom. Lock assembly 150 cooperates with hinge assembly 170 to secure lower section 122 to upper section 142 and secure plug assembly 108 therein.

Within upper section 142 is a first upper brace 144 and a second upper brace 146. Upper arc 162 combines with lower arc 132 to receive cord 112. Plug 110 mounts on the combination of lower braces 134 and 136, and upper braces 144 and 146, by supporting plug 110, hence plug and cord assembly 108 within the control pod 100.

Upon locking, the key lock assembly 150 can cause the lock bolt 152 to contact lock latch plate 154 and secure the plug head therein.

Hinge assembly 170 is mounted in standard fashion to the lower section 122 and upper section 142. Hinge spring 172 provides for ease of opening the pod when the lock is released. Spring 172 may also be reversed to permit for ease of closing the control pod 100.

In FIG. 2, combination lock assembly 190 is depicted with latch holes 192. Lock bolts 194 are in the upper section 142. In this fashion, the cord assembly 108 may be locked in by key lock assembly 150 or by combination lock 190.

FIG. 3 shows cord 112 sticking out of closed control pod 100 and profile view of key locked assembly 150 for control pod 100. By the same token, a side view as in FIG. 4 shows the key locked assembly 150 with the cord 112 sticking out. Thus, the cord assembly 108 is shown as secured therein.

In FIG. 5, the hinge assembly 170 is positioned completely within the control pod 100. With the hinge assembly 170 is positioned within lower section 122 and an upper section 142, beveling must occur so that control pod 100 may be opened. This is accomplished by beveled hinge edge 220. More particularly, lower section 122 has a lower beveled edge 222 while upper section 142 has an upper beveled edge 224, both being adjacent to hinge assembly 170. Lower beveled edge 222 combines with upper beveled edge 224 to permit control pod 100 to move lower section 122 up to 120 degrees relative to upper section 142. This opening is more than enough for the insertion or removal of plug and cord assembly 108 (FIG. 1).

With FIG. 6, the control pod 100 has the hinge assembly 170 mounted on the outside of the control pod 100. If the hinge assembly 170 is positioned on the outside of the control pod 100, it is possible for the sections 122 and 142 of the pod 100 to open 240 degrees.

Continuing with FIG. 7, the control pod 100, of this invention, wherein the hinge assembly 170 has a mid mounting point 230 and is partially mounted on the outside of the control pod 100. The sections of the pod 100 can open about 180 degrees, as reflected in FIG. 1 and FIG. 2.

As can be seen from FIG. 1 and FIG. 2 the hinge assembly 170 is preferably centered at one end of the short elliptical axis 180 on an edge of lower section 122 and upper section 142. At the opposing end of the short elliptical axis 180 is situation either combination lock 160 or key lock assembly 150. Such positioning provides the most efficient control pod 100.

This application—taken as a whole with the specification, claims, abstract, and drawings—provides sufficient information for a person having ordinary skill in the art to practice the invention disclosed and claimed herein. Any measures necessary to practice this invention are well within the skill of a person having ordinary skill in this art after that person has made a careful study of this disclosure.

Because of this disclosure and solely because of this disclosure, modification of this method and apparatus can become clear to a person having ordinary skill in this particular art. Such modifications are clearly covered by this disclosure.

What is claimed and sought to be protected by letters patent of the united states is:

1. A control pod for restricting use of an electrical appliance by securing a plug adapted to provide power to the electrical appliance; the control pod comprising:

(a) an upper section being connected to a lower section;

(b) the upper section combining with the lower section to secure the plug therein;

(c) a hinge securing the upper section to the lower section on a first side thereof;

(d) a locking means removably securing the upper section to the lower section on a second side thereof;

(e) the upper section having an upper radiused brace assembly to support the plug therein; and (f) the lower section having a lower radiused brace assembly to support the plug therein.

2. The control pod of claim 1 further comprising:

(a) the upper section containing an upper plug support;

(b) the lower section containing a lower plug support; and (c) the upper plug support and the lower plug support cooperating to support the plug when the control pod is in a closed position.

3. The control pod of claim 2 further comprising:

(a) the upper section having an upper cord arc adjacent to the upper plug support;

(b) the lower section having a lower cord arc adjacent to the lower plug support;

(c) the upper cord arc and the lower cord arc cooperating to support a cord for the plug when the control pod is in the closed position.

4. The control pod of claim 3 further comprising:

(a) the locking means being at least one selected from the group consisting a key operated lock and a combination operated lock;

(b) the control pod having an outer shape; and (c) the outer shape being substantially elliptical in appearance.

5. The control pod of claim 4 further comprising:

(a) the upper radiused brace assembly including a first upper radiused brace and a second upper radiused brace;

(b) the lower radiused brace assembly including a first lower radiused brace and a second lower radiused brace;

(c) the upper cord arc and the lower cord arc combining to provide an opening for the cord in the control pod;

(d) the first upper radiused brace, the second upper radiused brace, the first lower radiused brace, and the second lower radiused brace combining to form a channel for the cord; and (e) the channel communicating with the opening.

6. The control pod of claim 5 further comprising:

(a) the upper section and the lower section having symmetrical elliptical bases;

(b) the symmetrical elliptical bases each having short symmetrical axis and a long symmetrical axis;

(c) the hinge being situated at a first end of the short symmetrical axis;

(d) the locking means being situated at a second end of the short symmetrical axis; and (e) the first end being oppositely disposed from the second end.

7. The control pod of claim 6 further comprising:

(a) the channel being situated at an end of the long elliptical axis; and (b) the channel supporting the plug and the cord.

8. The control pod of claim 7 further comprising:

(a) the channel being situated at an end of the being situated at an end of the long elliptical axis; and (b) the channel being adapted to support the cord and the plug.

9. The control pod of claim 8 further comprising:

(a) the hinge assembly being positioned within the lower section and the upper section;

(b) the lower section having an exterior lower bevel adjacent to the hinge assembly;

(c) the upper section having an exterior upper bevel adjacent to the hinge assembly; and (d) the exterior lower bevel and the exterior upper bevel cooperating in order to permit the control pod to open.

10. The control pod of claim 9 further comprising the control pod being openable up to about 120 degrees.

11. The control pod of claim 9 further comprising:

(a) the hinge assembly being positioned on the outside of the control pod; and (b) the control pod being openable up to about 240 degrees.

12. The control pod of claim 9 further comprising:

(a) the hinge assembly being positioned on a midpoint of the upper section and the lower section; and (b) the control pod being openable up to about 180 degrees.

13. A control pod for restricting use of an electrical appliance by securing a plug adapted to provide power to the electrical appliance; the control pod comprising:

(a) an upper section being connected to a lower section;

(b) the upper section combining with the lower section to secure the plug therein;

(c) a hinge securing the upper section to the lower section on a first side thereof;

(d) a locking means removably securing the upper section to the lower section on a second side thereof;

(e) the control pod having an outer shape; and (f) the outer shape being substantially elliptical in appearance;

(g) the upper section and the lower section having symmetrical elliptical bases;

(h) the symmetrical elliptical bases each having short symmetrical axis and a long symmetrical axis;

(i) the hinge being situated at a first end of the short symmetrical axis;

(j) the locking means being situated at a second end of the short symmetrical axis; and (k) the first end being oppositely disposed from the second end.

14. The control pod of claim 13 further comprising:

(a) the upper section containing an upper plug support;

(b) the lower section containing a lower plug support; and (c) the upper plug support and the lower plug support cooperating to support the plug when the control pod is in a closed position.

15. The control pod of claim 13 further comprising:

(a) the upper section having an upper cord arc adjacent to the upper plug support;

(b) the lower section having a lower cord arc adjacent to the lower plug support;

(c) the upper cord arc and the lower cord arc cooperating to support a cord for the plug when the control pod is in the closed position.

16. The control pod of claim 15 further comprising:

(a) the locking means being at least one selected from the group consisting a key operated lock and a combination operated lock;

(b) the upper plug support including a first upper radiused brace and a second upper radiused brace;

(c) the lower plug support including a first lower radiused brace and a second lower radiused brace;

(d) the upper cord arc and the lower cord arc combining to provide an opening for the cord in the control pod;

(e) the first upper radiused brace, the second upper radiused brace, the first lower radiused brace, and the second lower radiused brace combining to form a channel for the cord;

(f) the channel communicating with the opening;

(g) the channel being situated at an end of the long elliptical axis; and (h) the channel supporting the plug and the cord.

* * * * *